US012070670B1

(12) United States Patent
Byers, II et al.

(10) Patent No.: US 12,070,670 B1
(45) Date of Patent: Aug. 27, 2024

(54) OVEN SLEEVE FOR GLOW DISC GOLF DISC AND METHOD OF USE

(71) Applicants: Loren James Byers, II, Fort Worth, TX (US); Andrew Vernon Boegler, Saginaw, TX (US)

(72) Inventors: Loren James Byers, II, Fort Worth, TX (US); Andrew Vernon Boegler, Saginaw, TX (US)

( * ) Notice: Subject to any disclaimer, the term of this patent is extended or adjusted under 35 U.S.C. 154(b) by 456 days.

(21) Appl. No.: 17/353,200

(22) Filed: Jun. 21, 2021

(51) Int. Cl.
*A63B 65/10* (2006.01)
*A63B 67/06* (2006.01)
*A63B 71/00* (2006.01)

(52) U.S. Cl.
CPC ..... *A63B 71/00* (2013.01); *A63B 67/06* (2013.01); *A63B 2225/76* (2020.08)

(58) Field of Classification Search
CPC ..... A63B 71/00; A63B 71/0036; A63B 67/06
See application file for complete search history.

(56) References Cited

U.S. PATENT DOCUMENTS

2015/0320187 A1* 11/2015 Kreutzer ..... A45F 3/20 222/105
2017/0340080 A1* 11/2017 DeLuz ..... A63H 33/18

* cited by examiner

*Primary Examiner* — David E Smith
*Assistant Examiner* — Hsien C Tsai
(74) *Attorney, Agent, or Firm* — Richard G. Eldredge; Leavitt Eldredge Law Firm

(57) ABSTRACT

An oven sleeve for a glow disc golf disc is described. The oven sleeve includes a front panel coupled to a rear panel via one or more sidewalls to define an interior cavity therebetween, the rear panel having a flap configured to fold over the front panel. The oven sleeve also includes a plurality of ultraviolet lights coupled to the interior cavity, a cable, and a battery pack. The battery pack supplies power to the ultraviolet lights via the cable.

3 Claims, 3 Drawing Sheets

OVEN SLEEVE FOR GLOW DISC GOLF DISC AND METHOD OF USE

BACKGROUND

1. Field of the Invention

The present invention relates generally to disc golf, and more specifically to an oven sleeve that utilizes a plurality of lights to charge a glow disc golf disc instantaneously, thereby allowing players to continue gameplay without interruption.

2. Description of Related Art

Disc golf has been growing in popularity within the past few years. Disc golf is a flying disc sport which involves players throwing discs into a series of disc golf baskets on a course. The goal of disc golf is to throw the disc toward each disc golf basket in the lowest number of throws. The player who has the lowest number of throws at the end of each course is the winner.

While disc golf can be played during the day, many players enjoy playing disc golf at night. To provide visibility during play at night, players can either use a glow disc made from glow plastic, place glow tape onto a conventional disc, or attach LED lights to a conventional disc. Unfortunately, these methods are inefficient in providing visibility. For example, glow discs and glow tape require enough light exposure in order to glow in the dark. Traditionally, players carry a UV flashlight and "rub" the flashlight on a glow disc to charge the glow disc, often for a few minutes, prior to throwing. This is cumbersome and often tires the player's arm, thereby affecting the quality of their throw. Moreover, flashlights are more prone to being dropped or left behind on a course, resulting in ending the game prematurely if no flashlight is available. As for attaching LED lights to a disc, the attachment changes the disc's profile, weight, and flight pattern, forcing players to adjust their throw to compensate the changes.

Hence, it would be advantageous to have a device that allows players to charge their glow disc efficiently without taking time away from gameplay as well as having no effect on the glow disc's profile, weight, and flight pattern.

Accordingly, although great strides have been made in the area of disc golf, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
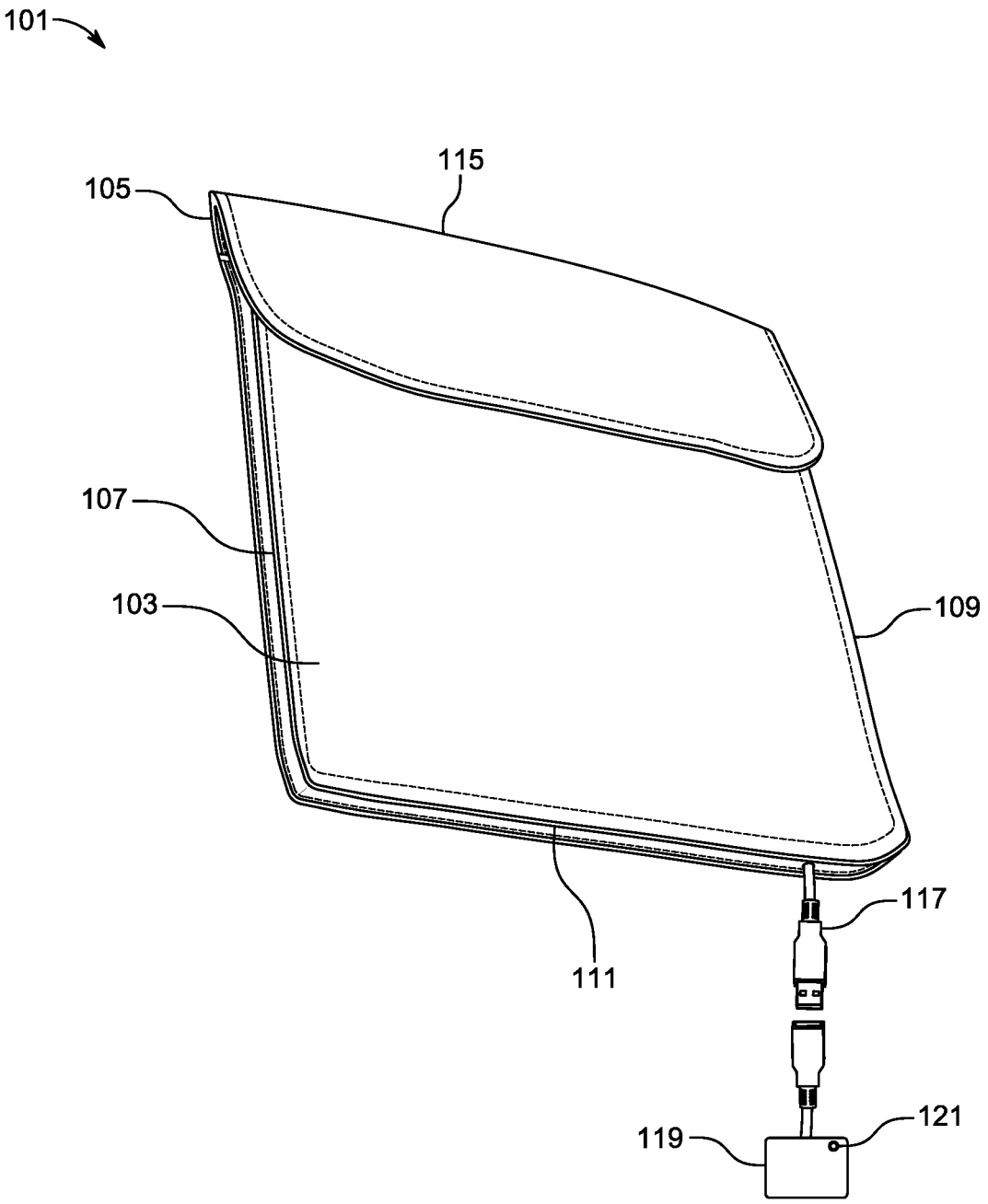
FIG. 1A is a perspective view of an oven sleeve in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with playing disc golf at night or in limited light conditions. Specifically, the present invention charges the glow properties of a glow disc golf disc instantaneously, thereby allowing players to play without interruption. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
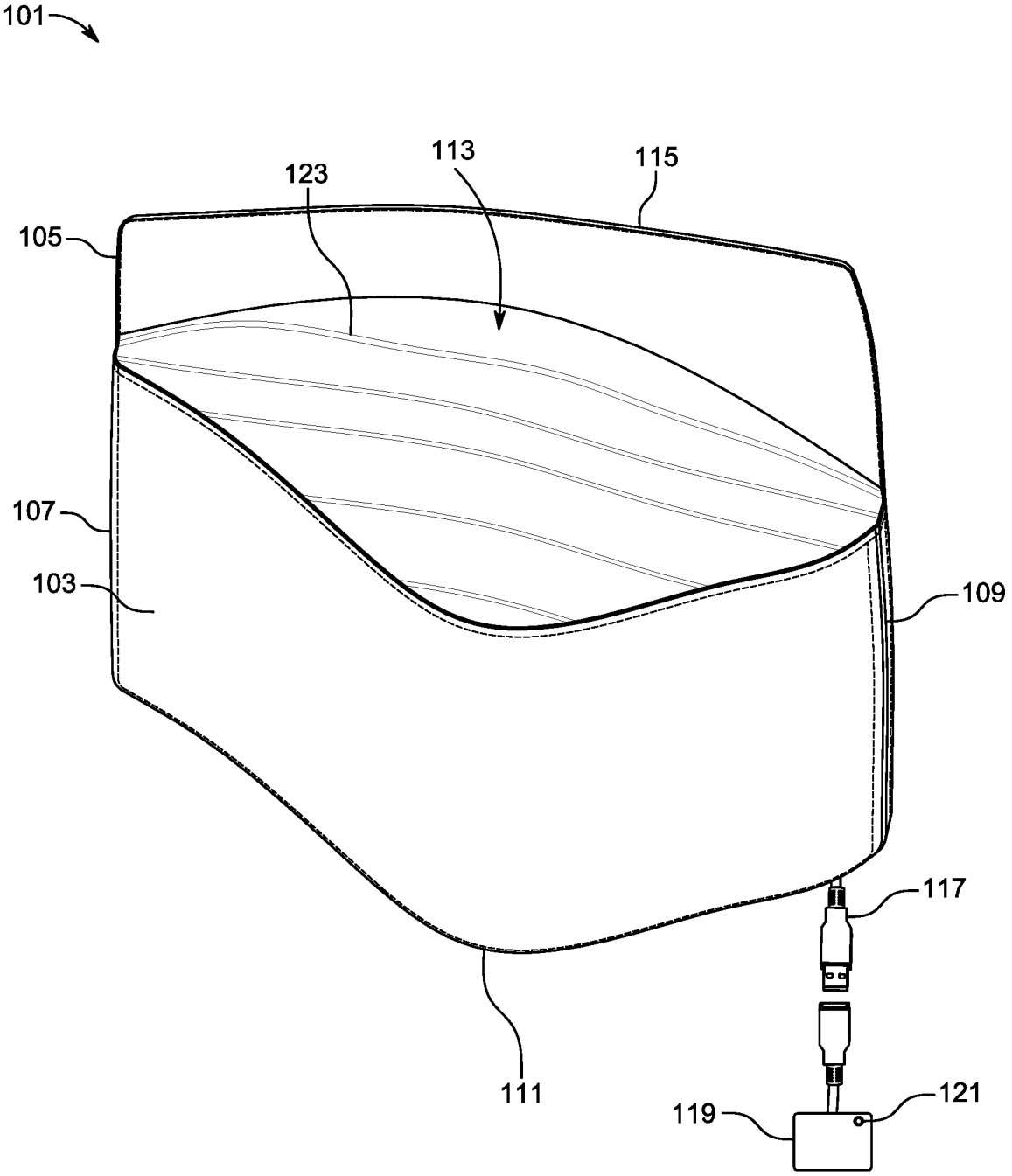
FIG. 1B is an interior view of an oven sleeve in accordance with a preferred embodiment of the present invention.

Referring now to the drawings wherein like reference characters identify corresponding or similar elements throughout the several views, FIGS. 1A-1B depict a front view and an interior view, respectively, of an oven sleeve 101 in accordance with a preferred embodiment of the present application. It will be appreciated that the oven sleeve 101 overcomes one or more of the above-listed problems commonly associated with playing disc golf at night or in limited light conditions.

In the contemplated embodiment, the oven sleeve 101 having a front panel 103 and a rear panel 105 that are connected (e.g., by an adhesive, folding, heat sealing, and/or other fusing techniques) via sidewalls 107, 109, 111 to define an interior cavity 113 between the front panel 103 and rear panel 105. The rear panel 105 includes a flap 115 that folds over the front panel 103 to close access to the interior cavity 113.

The oven sleeve 101 also includes a cable 117, a battery pack 119 having a power switch 121, and a plurality of ultraviolet (UV) lights 123. The battery pack 119 connects to the plurality of UV lights 123 via the cable 117. The plurality of UV lights 123 couple to the interior cavity 113.

It should be appreciated that although the cable 117 is shown to couple to the peripheral wall 109, it is contemplated that the cable 117 may vary in location.

In some embodiments, it should be appreciated that the battery pack 119 may be rechargeable. In addition, it should be appreciated that the battery pack 119 may include fasteners (not shown), preferably hook-and-loop fasteners, to removably couple the battery pack 119 to the oven sleeve 101 so that the battery pack 119 does not suspend from the oven sleeve 101.

In some embodiments, the cable 117 may couple to an external power source (not shown) to supply power to the plurality of UV lights 123.

In some embodiments, it should be appreciated that the flap 115 may be eliminated and access to the interior cavity 113 remains open. In other embodiments, the flap 115 may be eliminated and access to the interior cavity 113 may be removably closed through any type of fastener (not shown) desirable or suitable including, without limitation, zippers, buttons, snaps, hook-and-loop fasteners, hook-and-eye fasteners, other fasteners, or the like.

It should be appreciated that during use, when a player inserts a glow disc golf disc (not shown) into the oven sleeve 101 via the interior cavity 113, the plurality of UV lights 123 charges the glow disc golf disc instantaneously. The player may simply remove the glow disc golf disc from the oven sleeve device 101 for immediate use.

It should be appreciated that the oven sleeve 101 may vary based on aesthetical, functional, or manufacturing considerations. For example, the front and rear panels 103, 105 may include different colored materials and/or different colored patterns, images, and the like.

In some embodiments, it should be appreciated that the oven sleeve 101 may integrally formed as part of a carrying container, such as a bag, backpack, purse, or the like, or the oven sleeve 101 may be separately formed and engaged therewith (e.g., by a adhesives or cements; by welding, brazing, soldering, or other fusing techniques; by mechanical connectors; etc.) for versatile transportability.

It should also be appreciated that one of the unique features believed characteristic of the present application is the plurality of UV lights 123 that charge a glow disc golf disc instantaneously, thereby allowing players to continue gameplay without interruption.

Figure 2:
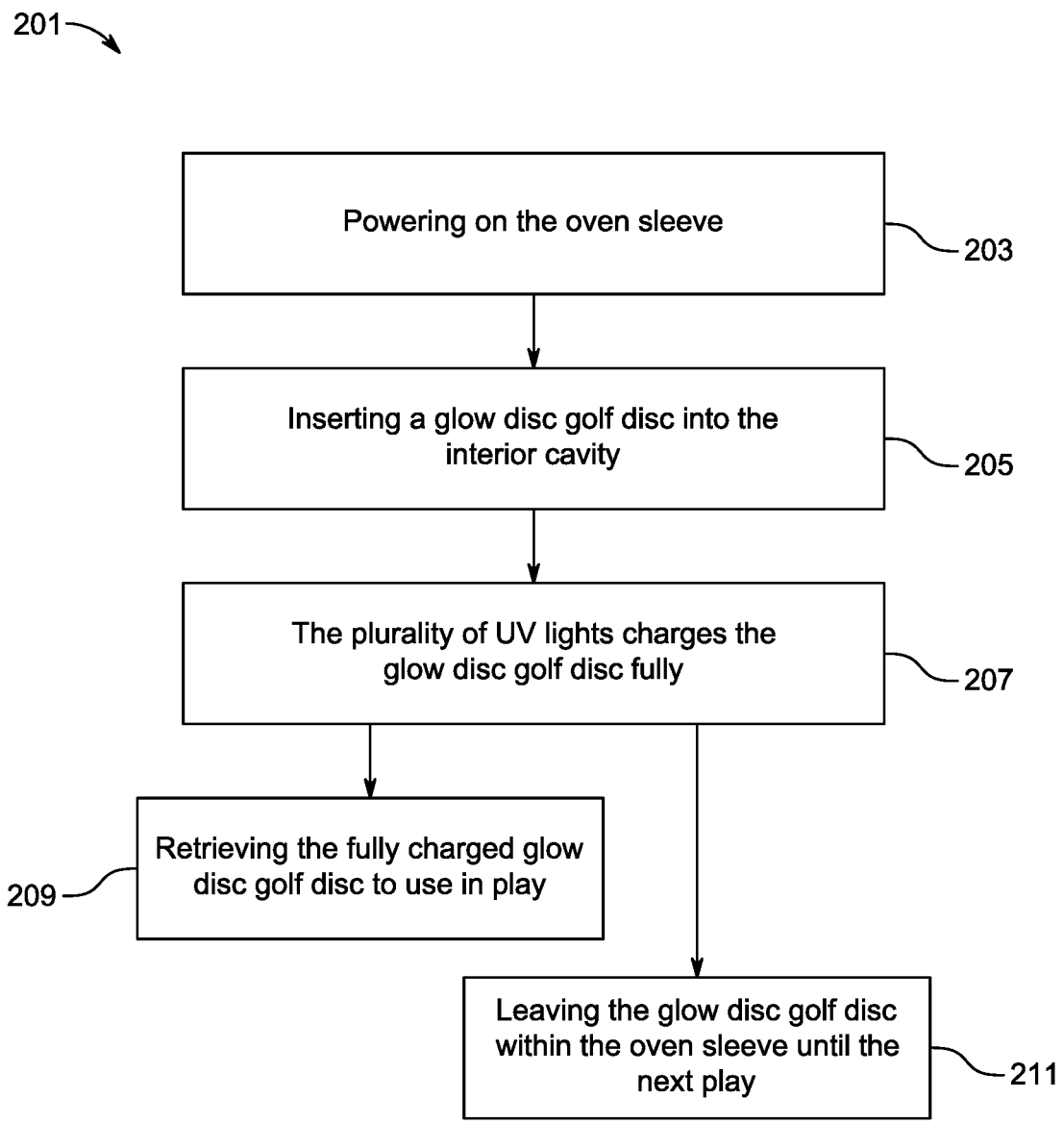
FIG. 2 is a flowchart of a method of use of the oven sleeve of FIGS. 1A and 1B.

In FIG. 2, a flowchart 201 depicts a method of use associated with the oven sleeve 101. During use, after a player powers on the oven sleeve device, the player may insert a glow disc golf disc into the interior cavity, as shown with boxes 203, 205. The plurality of UV lights charges the glow disc golf disc fully, as shown with box 207. The player may then retrieve the fully charged glow disc golf disc to use in play or leave the glow disc golf disc within the oven sleeve until the next play, as shown with boxes 209, 211.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An oven sleeve for charging a glow golf disc, comprising:

a front panel coupled to a rear panel via one or more sidewalls to form a single interior cavity therebetween, the rear panel having a flap configured to fold over the front panel and completely cover the single interior cavity;

a plurality of ultraviolet lights disposed within an interior wall of the single interior cavity, the plurality of ultraviolet lights are in electric communication with a cable that extends from a sidewall of the one or more sidewalls; and a battery pack having a power switch, the battery pack having one or more fasteners configured to removably couple the battery pack to the front panel or rear panel, the battery pack is configured to supply power to the plurality of ultraviolet lights via the cable and is configured to removably attach to the cable;

wherein the single interior cavity is configured to receive a glow disc golf disc; and wherein the plurality of ultraviolet lights fully charges the glow disc golf disc within the single interior cavity.

2. The oven sleeve of claim 1, further comprising one or more fasteners configured to removably close access to the single interior cavity.

3. A method of charging a glow disc golf disc, the method comprising:

providing the system of claim 1;

turning on the battery pack;

inserting the glow disc golf disc into the single interior cavity;

charging the glow golf disc via the plurality of ultraviolet lights; and removing the glow disc golf disc from the single interior cavity;

wherein the glow disc golf disc is fully charged upon removal.

* * * * *